US008522884B2

(12) United States Patent
Miller

(10) Patent No.: US 8,522,884 B2
(45) Date of Patent: Sep. 3, 2013

(54) LANDING SYSTEM FOR WELL CASING

(76) Inventor: David M. Miller, Bakersfield, CA (US)

( * ) Notice: Subject to any disclaimer, the term of this patent is extended or adjusted under 35 U.S.C. 154(b) by 303 days.

(21) Appl. No.: 12/927,572

(22) Filed: Nov. 17, 2010

(65) Prior Publication Data

US 2011/0132624 A1 Jun. 9, 2011

Related U.S. Application Data

(60) Provisional application No. 61/262,912, filed on Dec. 7, 2009.

(51) Int. Cl.
*E21B 23/02* (2006.01)

(52) U.S. Cl.
USPC ..... 166/382; 166/208

(58) Field of Classification Search
USPC ..... 166/348, 382, 208
See application file for complete search history.

(56) References Cited

U.S. PATENT DOCUMENTS

| | | | | |
|---|---|---|---|---|
| 4,653,589 | A * | 3/1987 | Alandy | 166/382 |
| 5,607,019 | A * | 3/1997 | Kent | 166/344 |
| 5,653,289 | A * | 8/1997 | Hosie et al. | 166/348 |
| 7,219,738 | B2 * | 5/2007 | Reimert | 166/348 |

* cited by examiner

*Primary Examiner* — William P Neuder
(74) *Attorney, Agent, or Firm* — Workman Nydegger

(57) ABSTRACT

The method of installing a plurality of casing sections in a well, that includes providing a hanger supporting the casing sections to extend longitudinally in the well, landing the hanger on structure in the well, whereby weight of the casing sections longitudinally compresses the hanger, cementing the casing sections in position in the well, below the hanger, adjusting the hanger to provide for controllable longitudinal shortening of hanger length, thereby removing exertion of casing weight on the hanger, and removing at least part of the hanger away from the well head.

41 Claims, 17 Drawing Sheets

LANDING SYSTEM FOR WELL CASING

This invention claims priority from provisional application Ser. No. 61/262,912, filed Nov. 19, 2009.

BACKGROUND OF THE INVENTION

This invention relates generally to methods and apparatus utilized in the completion of hydrocarbon wells, and is particularly directed to methods for reducing the amount of drillrig time and associated expense associated with hanging casing or tubing within a previously installed concentric outer casing.

A hydrocarbon well typically employs a plurality of tubular or concentric casing strings extended from the ground surface toward the subsurface hydrocarbon reservoir, with the outermost string having the largest diameter and being the shortest in length, with each inner string having a smaller diameter and a longer length. The outermost pipe, the conductor pipe, is installed as part of site preparation and will be present when the drilling rig moves onto the location. The conductor pipe typically extends from a depth of 20 to 100 feet, and will have a diameter of 4 inches or larger. A starting head/drilling rig is attached to the top of the conductor pipe for connecting to blowout prevention equipment, i.e. BOP and typically a diverter. The casing head typically on the surface casing will usually have an internal shoulder.

Once moved on location, the drilling rig drills to the surface/next casing point, which is a predetermined depth set below freshwater bearing zones, or difficult strata such as sloughing clay or gravel zones. Typically, this first casing point extends from a few hundred to a thousand feet below ground surface. Once the first casing point is reached, the surface casing is run into the well, and cemented in place, usually by pumping cement down through the inside of the casing, and continuing to pump until the cement exits the bottom of the casing and circulates up into the annulus between the open hole and the outside of the surface casing.

Once cementing operations have been completed on the surface casing and the cement adequately hardened, a blowout preventer (BOP) stack is nippled down and removed from under the rig. The drilling rig is cut off and removed. The surface casing is cut and dressed to land/install a surface casing well head. A BOP is re-installed and attached or nippled up to the casing head. Drilling thereafter continues, until the next casing point is reached, at which time a smaller string of casing is run into the well. Depending upon the integrity of the drilled strata and the anticipated depth of the well, the casing point may extend all of the way to the production zone, and production casing installed. Alternatively, one or more intermediate strings of casing may be concentrically installed within the surface casing. The production casing typically extends from the ground surface to the production zone which may be thousands of feet down. In some cases, the production casing is hung or attached to the bottom of the surface casing, or intermediate casing.

The production casing is cemented in place, and after all of the cement has been pumped into place, the casing string is held stationary while the cement sets up. Thereafter, a slip-type casing hanger is placed around the top joint of the production casing, which is typically landed against an internal shoulder of a casing spool or newly attached wellhead.

In well completions the casing is preferably hung in tension to reduce the possibility of casing collapse. Such collapse is possible when the top of the casing is locked into position within the wellhead. For example, if the well is subject to thermal stimulation, the casing will expand and place the casing string into buckling, because the top of the casing is locked in place at the wellhead.

In most applications, before landing the surface casing, production casing string, or intermediate casing string, it is necessary to remove the blowout preventer stack to land the casing string within a well head spool at wellhead. Removal of the blowout preventer stack is time consuming, and requires a drilling rig to sit idle for hours while the stack is removed, the casing spool or wellhead attached, and the blowout preventers nippled back up. Because of the relatively high expense for rig time, this delay is expensive. In addition, if the well proves to be productive, the wellhead and casing hanging equipment utilized in this procedure are permanently installed in the well. These devices are usually expensive and add substantially to the expense of the well.

SUMMARY OF THE INVENTION

It is a major object of the invention to provide method and apparatus to meet needs associated with the above described operations. Basically, the method of installing a plurality of casing sections in a well, includes the steps a) providing a hanger supporting the casing sections to extend longitudinally in the well,
b) landing the hanger on structure in the well, whereby weight of the casing sections longitudinally compresses the hanger,
c) cementing casing sections in position in the well, below the hanger,
d) adjusting the hanger to provide for controllable longitudinal shortening of hanger length, thereby removing exertion of casing weight on the hanger,
e) and removing at least part of the hanger away from the well head.

In one mode, the d) and e) steps may include:

d) adjusting the hanger to allow controllable expansion of at least a portion of the hanger and longitudinal shortening of hanger length in response to relief of hanger generally sideward compression,
e) and removing at least said expanded portion of the hanger from the well.

As will be seen, the hanger may typically have interengaged wedge surfaces that interengage to induce lateral expansion of the hanger portion. Also, such wedge surfaces preferably extend angularly laterally and longitudinally, and define upper and lower interengaged surfaces, as for example with V-shape, and/or converted V-shaped.

A further object includes provision for use of a hanger that has an expansible wall portion on which at least one of such wedge surfaces is located. Retention means is typically provided and used for blocking the wall portions against expansion, and is adjustable to allow unblocking of lateral expansion of the hanger.

Yet another object includes the step of severing the upper portion of the hanger from a lower mandrel portion of the hanger, to allow removing of the upper portion of the hanger from the well. In this method, lateral expansion of the hanger serves to facilitate removal of the upper portion of the hanger from the well. The mandrel is typically landed prior to such severing, in supporting relation to the wedge surfaces, to allow their relative sliding.

Accordingly, the present method and apparatus are directed toward eliminating the need to lock the top of a casing into a wellhead, as well as the need to remove and reinstall a blowout preventer stack as part of the process in landing a string of casing joints within a hydrocarbon well, where the casing is to be cemented in place. Attached to the last joint of the string run into the well is a hanger, embodiments of which are disclosed herein. The hanger is landed onto a load shoulder, or other structure installed within or upon the uppermost joint of the previously installed string of casing outside of the string being installed.

The method and apparatus allow the utilization of an alternative assembly, as disclosed, for attachment of the blowout preventer, although the conventional assembly may also be utilized. Installation of the equipment may take place after the hanging of the casing using an embodiment of the disclosed hanger. A diverter spool may be made up directly to the top of the conductor pipe, with the blowout preventer made up to the diverter spool. The hanger and casing may be hung and cemented in place below the mandrel load shoulder of the lower bowl, with cement return taken through the diverter spool. After the cement has hardened, the blowout preventer may be removed and the wellhead installed, with the casing already landed and cemented in place.

In contrast to known casing hangers, the hanger utilized in the present method typically and preferably comprises length adjustment means, where the hanger is adjustable between a first length and a second length, and where the first length is longer than the second length. The casing string is suspended from the hanger, and the hanger, in turn, is suspended within the well. Cement is thereafter circulated within the well, whereby the cement forms a sheath around a portion of the casing string, and the casing is typically in tension. After the cement is allowed to reach a predetermined strength, the hanger is adjusted to second length, after which tension on the casing string is released, the top of the casing not being rigidly locked into place. Because the disclosed hanger is landed within the uppermost joint of the previously installed casing strings, there is no need to nipple down the blowout preventer.

A further object is to provide axially exerted force acting on the hanger, by one of the following:

i) axially extending bolts exerting force on axially spaced hanger sections, ii) axially extending hydraulic ram structure exerting force on axially spaced hanger sections, iii) axially extending jacking structure exerting force on axially spaced hanger sections.

While the above is a description of various embodiments of the present invention, further modifications may be employed without departing from the spirit and scope of the present invention. Thus the scope of the invention should not be limited according to these factors, but according to the claims to be filed in the forthcoming utility application.

BRIEF DESCRIPTION OF THE DRAWINGS

FIG. 26' is a schematic view of structure seen in FIG. 26;

FIG. 31' shows the FIG. 31 apparatus in adjusted state;

FIG. 41' shows the FIG. 41 apparatus after shortening;

FIG. 48' shows the FIG. 48 apparatus after shortening;

DETAILED DESCRIPTION

Figure 6:
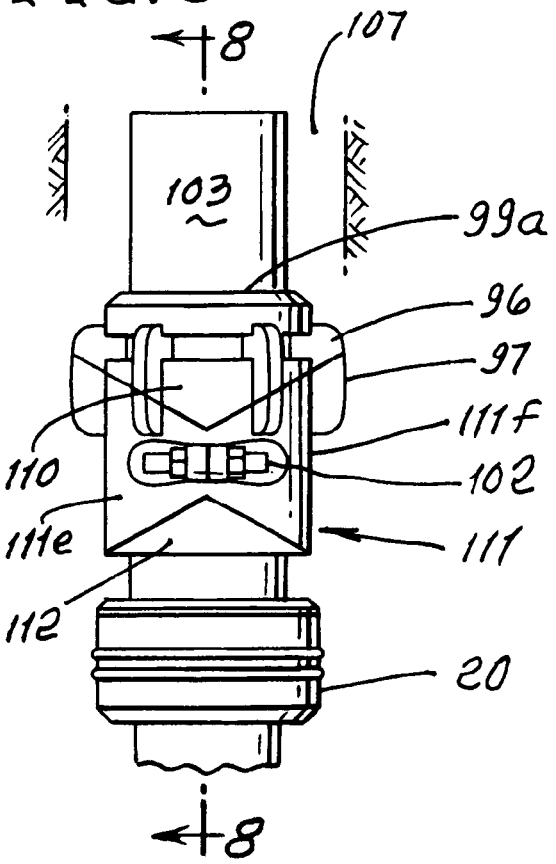
FIG. 6 shows a side view of the hanger supporting well casing.
Figure 7:
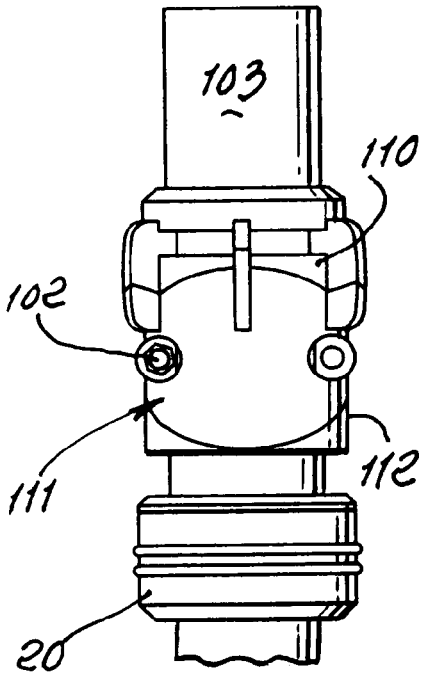
FIG. 7 shows a front view of the FIG. 6 hanger and casing shown in FIG. 5.
Figure 8:
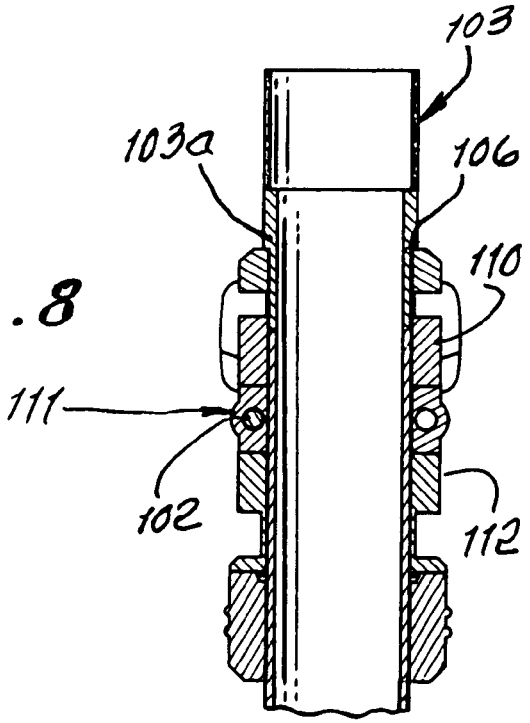
FIG. 8 is a section taken on lines 8-8 of FIG. 6.
Figure 12:
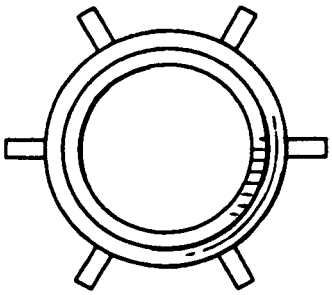
FIG. 12 shows a top view of the wedge member as shown in FIG. 9.
Figure 9:
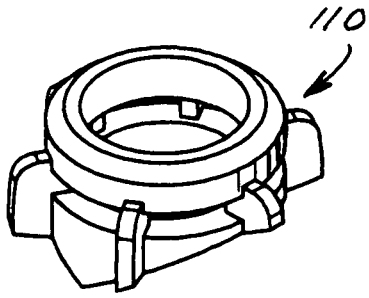
FIG. 9 shows an isometric view of an upper wedge member of the hanger.
Figure 10:
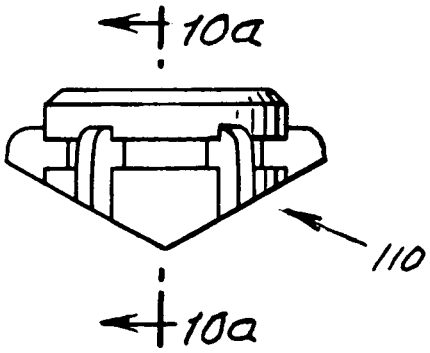
FIG. 10 shows a side view of the wedge member as shown in FIG. 9.
Figure 11:
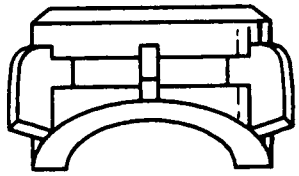
FIG. 11 shows a front view of the wedge member as shown in FIG. 9.
Figure 10A:
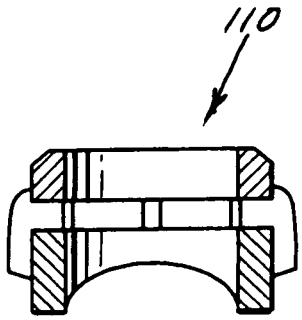
FIG. 10*a* is a section taken on lines 10*a*-10*a* of FIG. 10.
Figure 16:
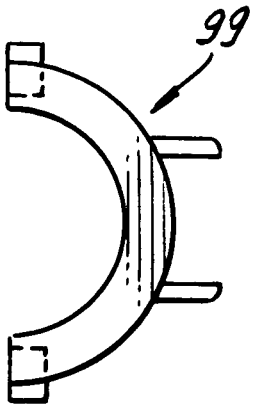
FIG. 16 shows a top plan view of one section of the two sections wedge member of FIG. 15.
Figure 13:
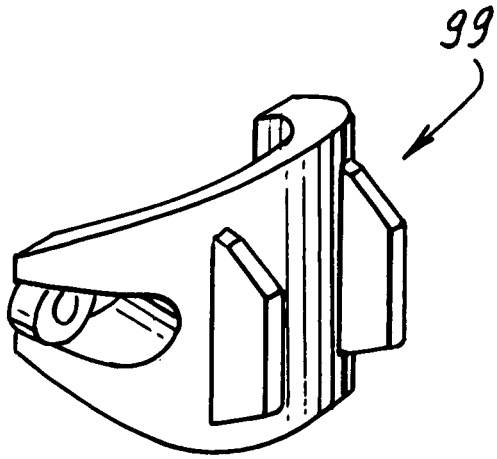
FIG. 13 shows an isometric view of an intermediate wedge member of the casing hanger.
Figure 14:
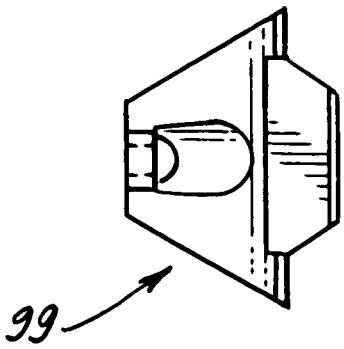
FIG. 14 shows a side view of the intermediate wedge member shown in FIG. 13.
Figure 15:
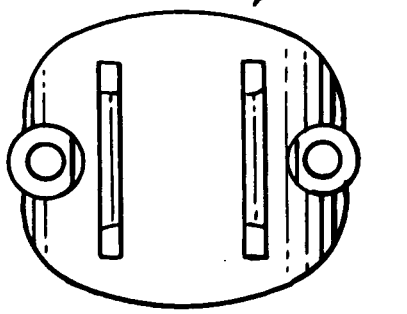
FIG. 15 shows a top plan view of the top wedge member of FIG. 13.
Figure 20:
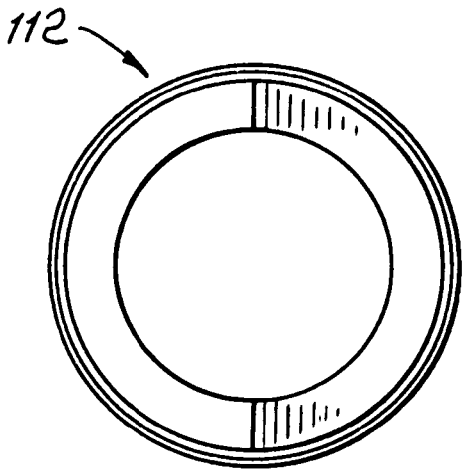
FIG. 20 shows a top view of the bottom wedge member shown in FIG. 17.
Figure 17:
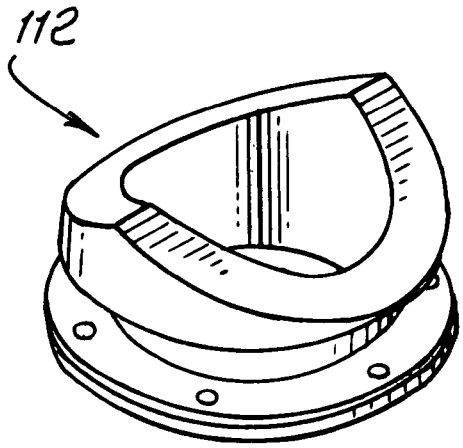
FIG. 17 shows an isometric view of the bottom wedge member of the casing hanger.
Figure 18:
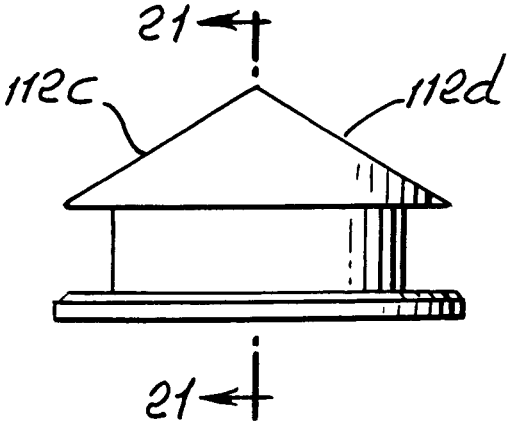
FIG. 18 shows a side view of the bottom wedge member, seen in FIG. 17.
Figure 19:
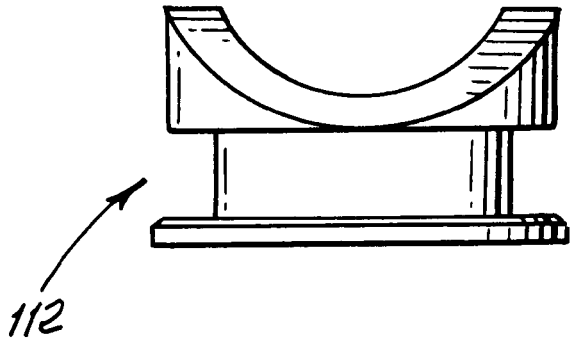
FIG. 19 shows a front view of the bottom wedge member shown in FIG. 17.
Figure 21:
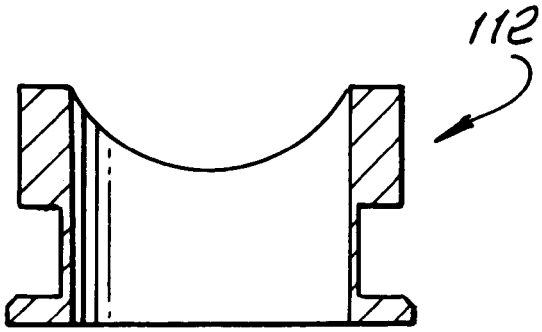
FIG. 21 is a section taken on lines 21-21 of FIG. 18.
Figure 22:
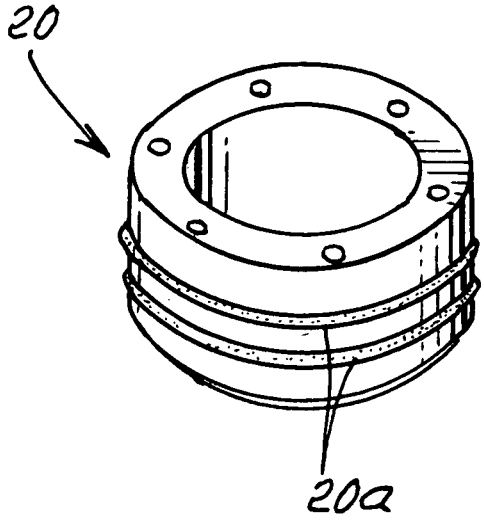
FIG. 22 shows an isometric view of a mandrel section of the casing hanger.
Figure 25:
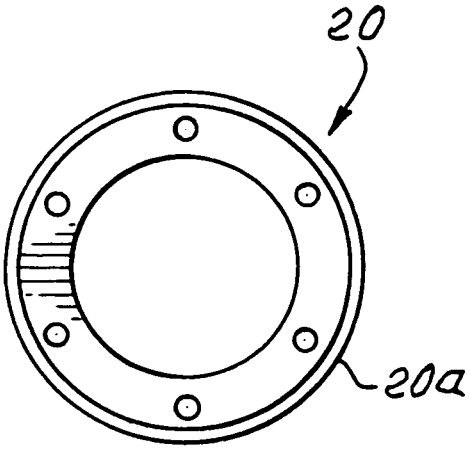
FIG. 25 shows a top view of the mandrel section shown in FIG. 22.
Figure 23:
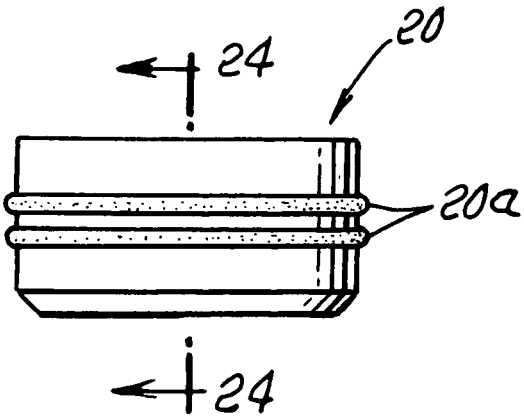
FIG. 23 shows a side view of the mandrel section seen in FIG. 22.
Figure 24:
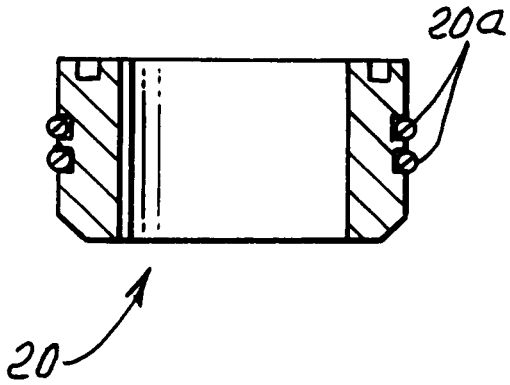
FIG. 24 shows a front view of the mandrel section shown in FIG. 22.
Figure 26:
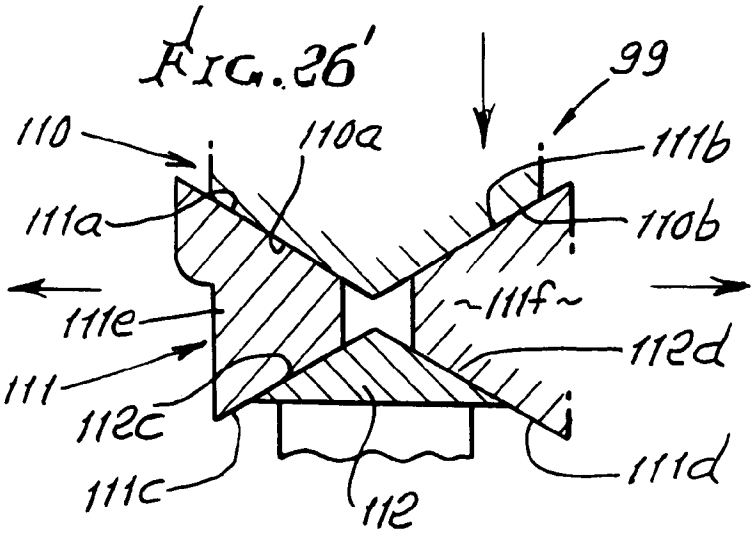
FIG. 26 shows the hanger of FIG. 6 with the upper section dropped down.
Figure 28:
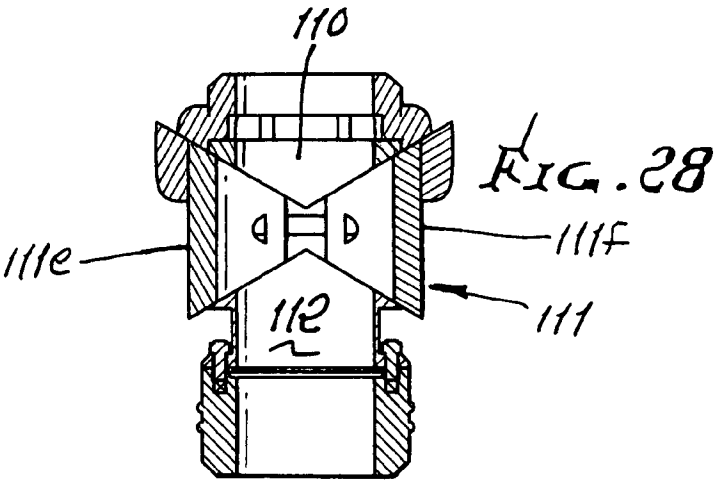
FIG. 28 is a section taken on lines 28-28 of FIG. 27.
Figure 26:
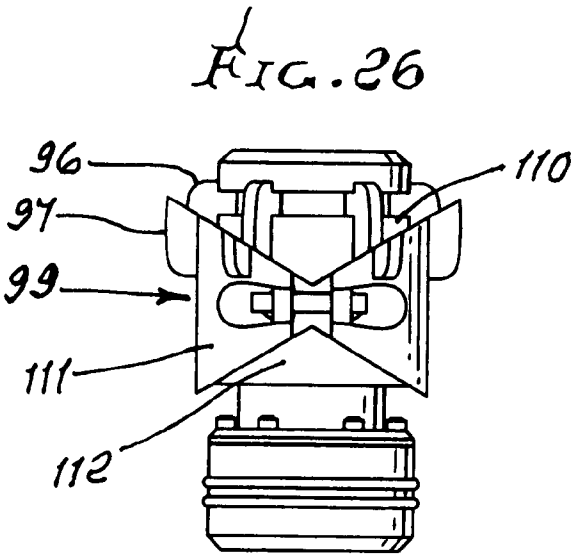

Referring first to FIGS. 6 and 26, they show hanger 99 upper, lower and intermediate members 110, 111 and 112 prior to (FIG. 6) and after (FIG. 26) lateral translation or expansion of intermediate member 112 relative to upper and lower members 110 and 111. Simplified schematic view 26' corresponds to FIG. 26. Such lateral translation is facilitated by sliding slippage of upward facing upper V-shaped wedge surfaces 111*a* and 111*b* on member 111, relative and with respect to downward facing upper V-shaped wedge surfaces 110*a* and 110*b* on 110; and simultaneous sliding slippage of downward facing lower inverted V-shaped wedge surfaces 111*c* and 111*d* relative and with respect to upward facing lower inverted V-shaped wedge surfaces 112*c* and 112*d* on 112. This enables downward bodily displacement of 110 relative to and beneath wall casing 103 flange or shoulder 103*a* previously landed on the top 99*a* of hanger 99, the casing then connected in position in the well, whereby casing loading on the shortened hanger is relieved. This in turn enables sideward and outward removal of meshing 110 and 111 from beneath member 99.

Note, that member 111 is in two sections, 111*e* and 111*f* held in FIG. 6 position (prior to lateral displacement) by a fastener device or devices, such as bolts 102 that extend horizontally between the sections 111*e* and 111*f*. Upon loosening of those bolts, the downwardly composed weight effects member sliding, as referred to. A further advantage of this V-shaped configuration of sliding surfaces is the maintenance of vertical alignment of the members 110-112, precluding interference with well structure, at the side or sides of the hanger structure. Angularity of the V-shaped member surfaces is typically about 30° relative to horizontal.

Centering guides 96 and 97 on 99 and 111 serve to center the hanger in position at the well head.

Accordingly, the members 99, 110 and 111 are then easily removed, and the mandrel 20 below and supporting member 111 is upwardly removed, whereby the hanger is removed, from support at 106, leaving the casing 103 projecting upwardly in the top well zone 107. Support shoulder 106 is typically provided by outer casing in the well. Accordingly, means is provided whereby the hanger is expanded laterally and lengthwise shortened, in response to disconnection of hanger elements, such as bolt 102 and in response to imposed casing weight, facilitating ease of removal of the hanger from the top zone of the well.

Figure 4:
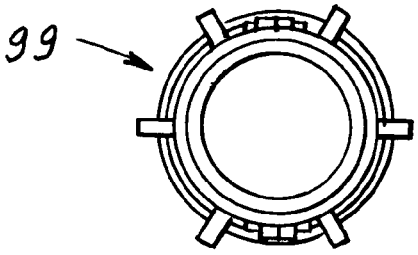
FIG. 4 shows a top view of the casing hanger shown in FIG. 1.
Figure 1:
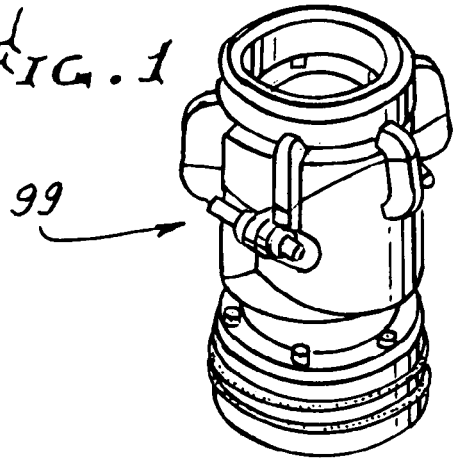
FIG. 1 shows an isometric view of a casing hanger.
Figure 2:
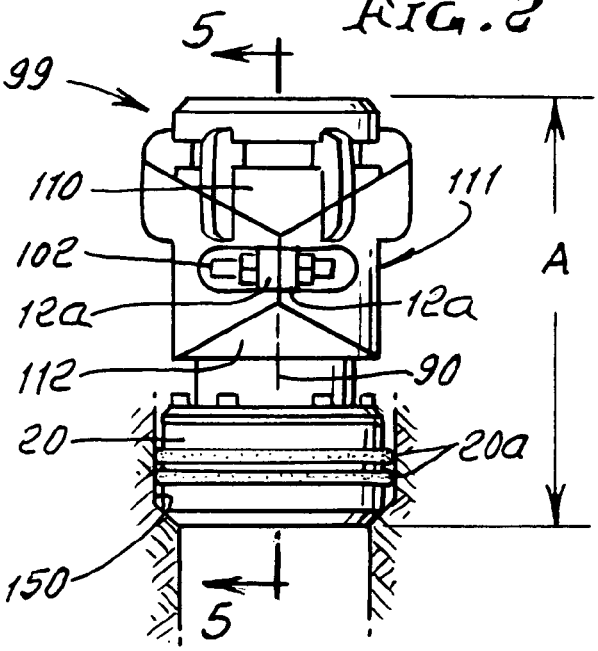
FIG. 2 shows a side view of the casing hanger shown in FIG. 1.
Figure 3:
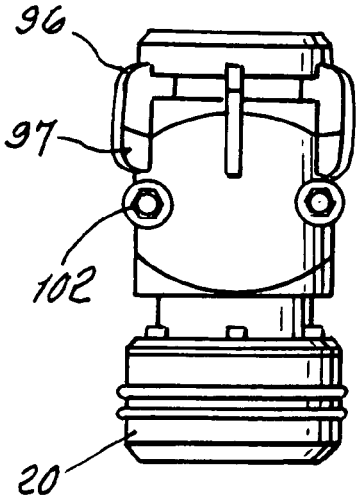
FIG. 3 shows a front view of the casing hanger shown in FIG. 1.
Figure 5:
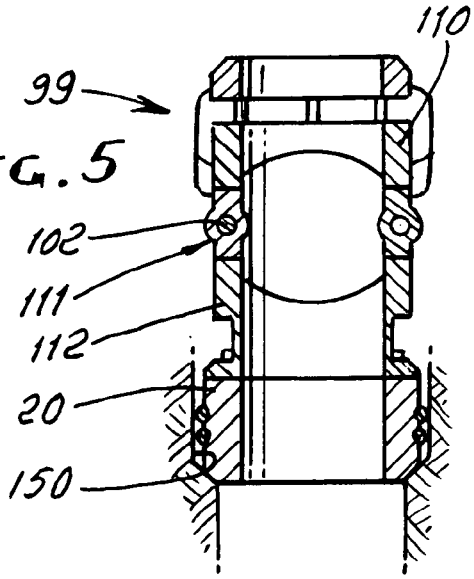
FIG. 5 is a section taken on lines 5-5 of FIG. 2.
Figure 27:
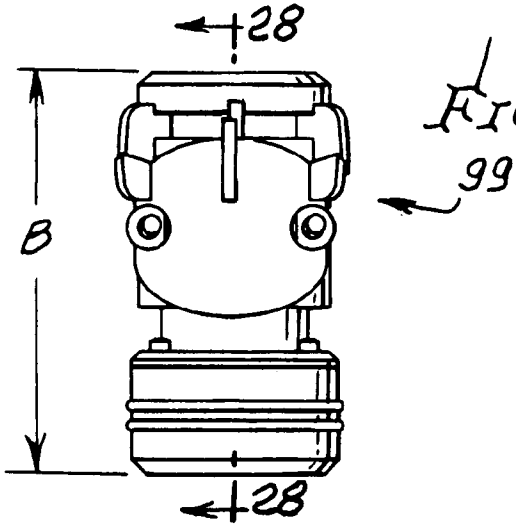
FIG. 27 shows a front view of the hanger of FIG. 26.
Figure 29:
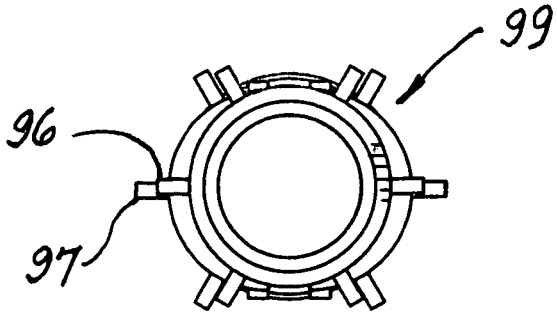
FIG. 29 shows a top view of top wedge member seen in FIG. 27, and which may be utilized in the FIG. 26 hanger.
Figure 30:
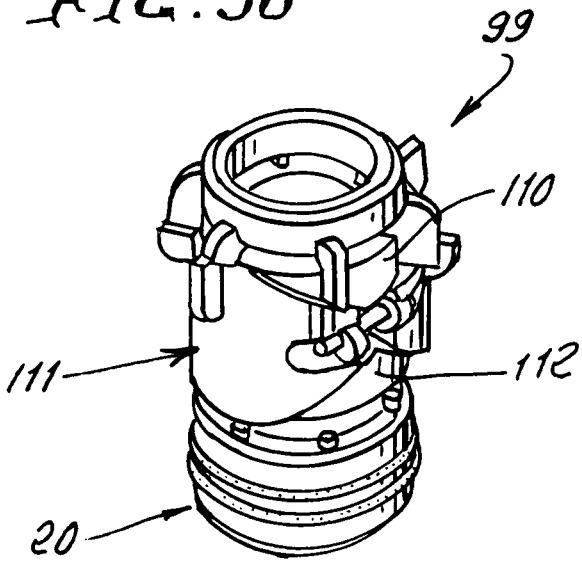
FIG. 30 is an isometric view of the FIGS. 26-18 shortened hanger.
Figure 34:
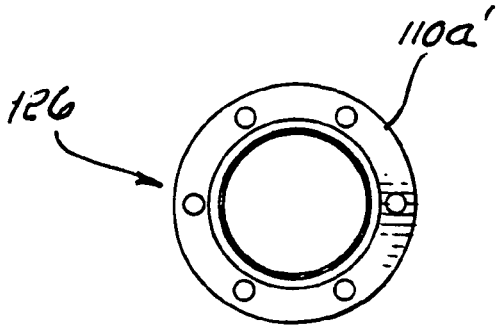
FIG. 34 is a top plan view of the FIG. 32 apparatus.

Referring now to FIGS. 1-8, the hanger 99 is generally tubular, and is shown in its first length configuration. It may be adjusted to its second and shortened length by loosening the bolts 102 that clasp together flanges 12*a* on the two sections of 111, at opposite sides of axes 90. The intermediate wedge member sections slide laterally oppositely along diagonal upper and lower surfaces as referred to and sections 111*c* and 111*d* move radially outwardly. The casing hanger moves to shortened position. The casing hanger 99 may further comprise the lower supporting mandrel 20 having rubber O-rings 20*a* to seal against casing bore, or outer conductor casing. See bore 150 in FIGS. 2 and 5. Mandrel 20 may be left in the well to provide a seal in the annulus between the casing being hung with the casing hanger 99 and the previously installed casing string, in which the casing hanger is suspended. The mandrel is typically bolted to hanger section 112. FIGS. 2 and 27 show hanger length dimensions A and B, before and after hanger adjustment, below casing flange 103*a*.

As shown in the Figures and described, the intermediate section 111, is of split construction 111*e* and 111*f* which allows the hanger to be taken apart in place in sections, facilitating removal of the hanger from the cemented casing or tubing, and below casing flange 103*a*.

Figure 35:
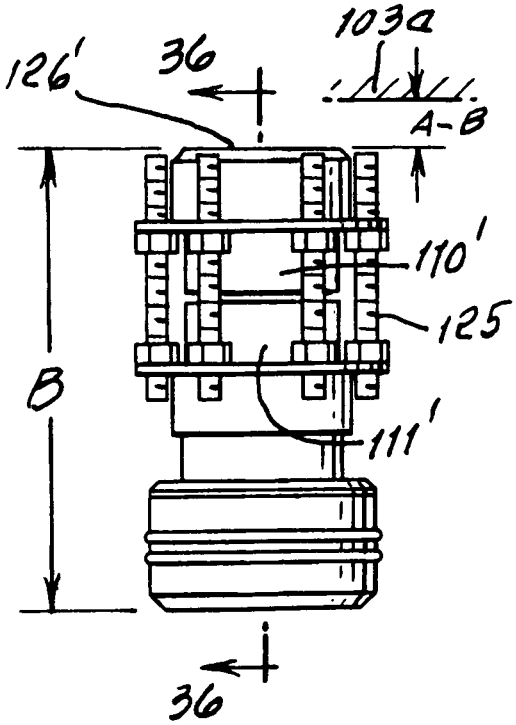
Figure 36:
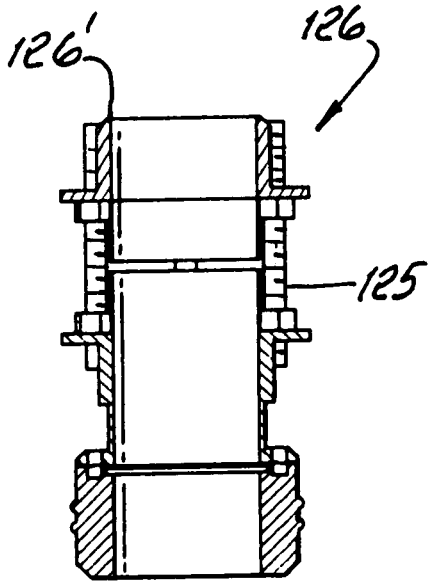
Figure 40:
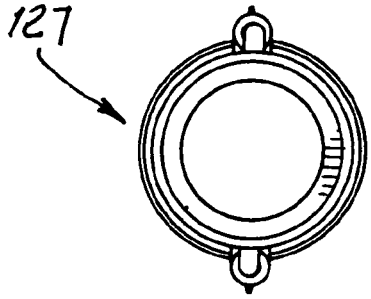
FIGS. 38-40 correspond to FIGS. 32-34, but show another modified hanger apparatus, prior to shortening.

Referring now to FIGS. 31-37, they show an alternative form of the hanger 126 that employs vertical bolts or fasteners 125 rotatable to shorten the hanger length as from a long measurement A (see FIG. 32) to a short measurement B (see FIG. 35). This lowers the casing flange support shoulder 126' on the top of the hanger by amount A-B below the casing flange 103*a*, relieving energy or tension in the initially hanger supported casing 103. Bolts 125 can easily be removed to allow removal of the hanger upper and lower elements 110' and 111' described above. Upper element 110' is spaced above element 111'. Bolt adjustment moves bolt flange 110*a'* toward bolt flange 111*a'* on 111*a*.

Figure 31:
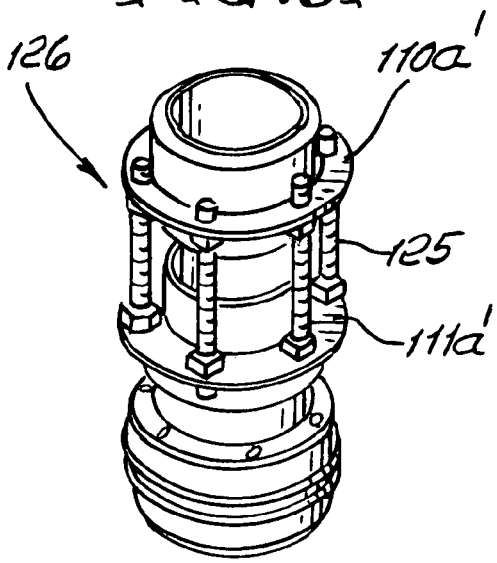
FIG. 31 shows a modified form of hanger shortening apparatus.
Figure 32:
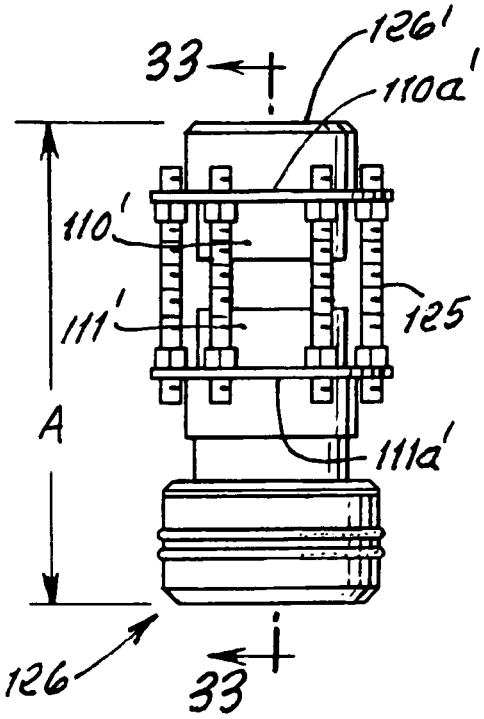
FIG. 32 is a side view of the FIG. 31 apparatus.
Figure 33:
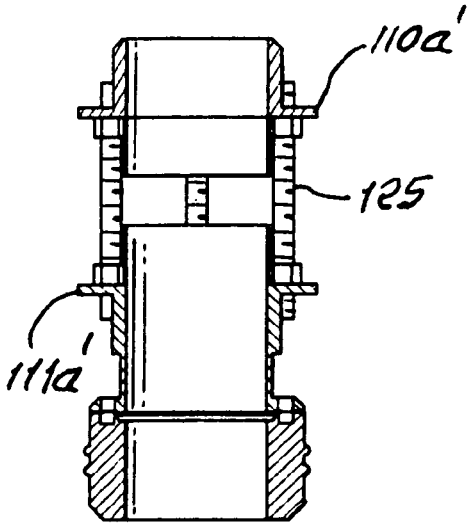
FIG. 33 is a section taken on lines 33-33 of FIG. 32.
Figure 31:
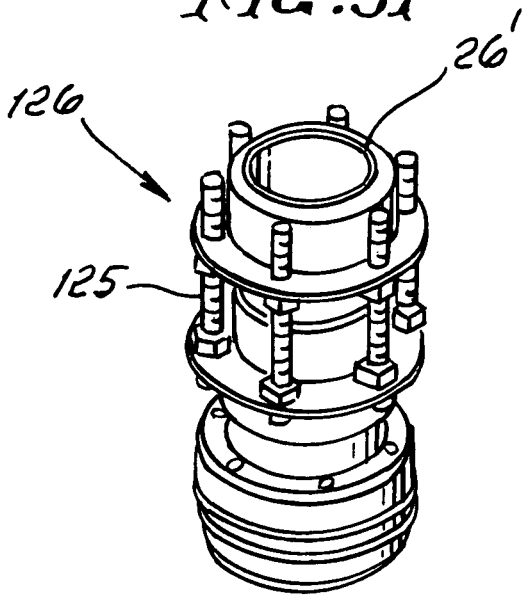
Figure 37:
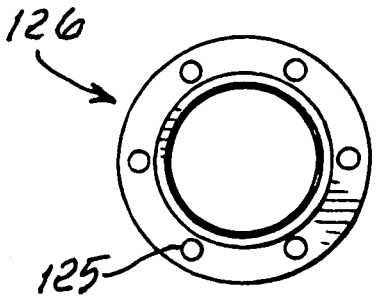
FIGS. 35, 36 and 37 correspond to FIGS. 32. 33 and 34, but after hanger shortening as in FIG. 31'.

FIGS. 31 and 31' show the hanger prior to after its axial shortening.

Figure 41:
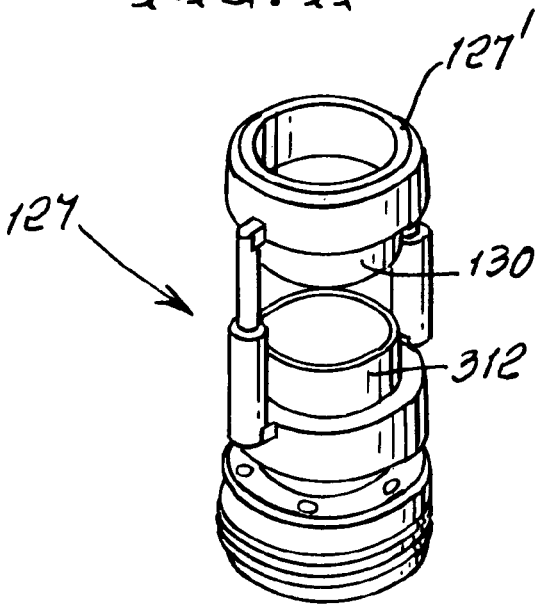
FIG. 41 is an isometric view of the FIGS. 32-34 apparatus.
Figure 38:
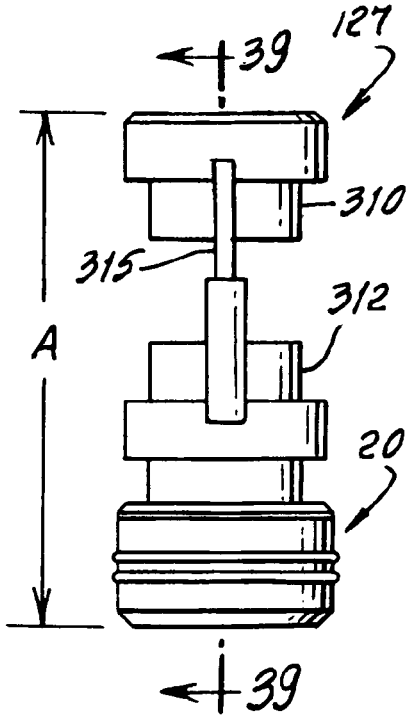
Figure 39:
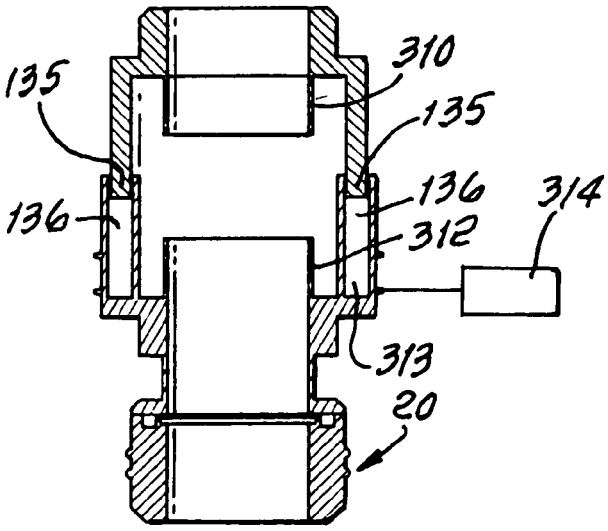
Figure 44:
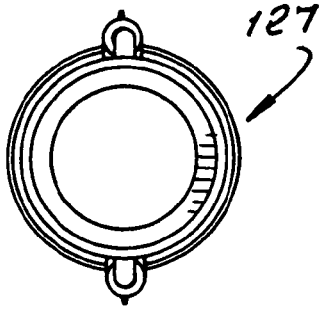
FIGS. 42-44 correspond to FIGS. 38-40, showing the hanger after shortening.
Figure 41:
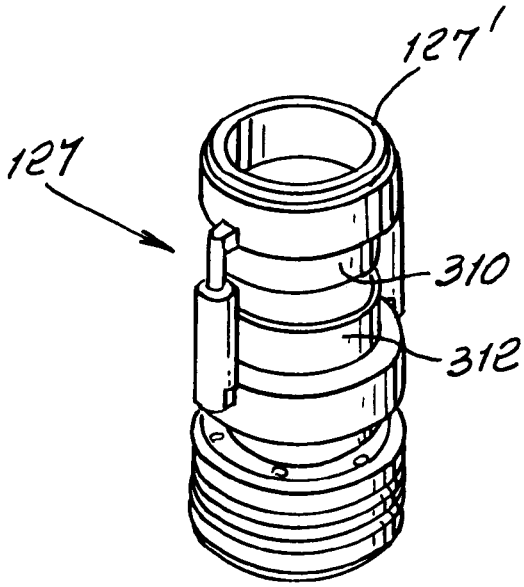
Figure 42:
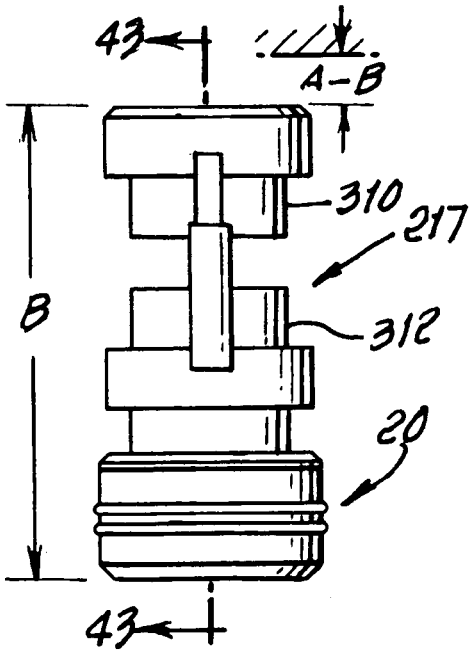
Figure 43:
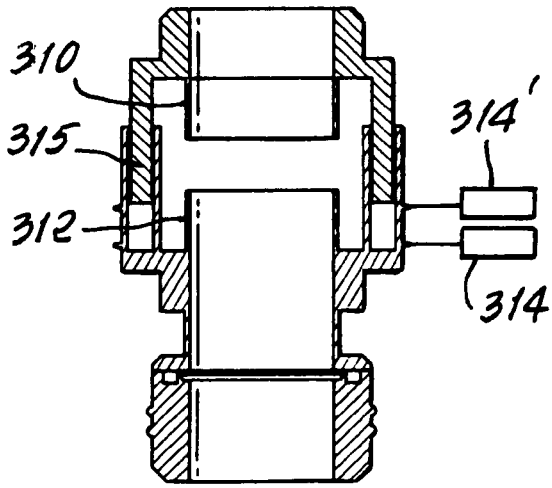
Figure 47:
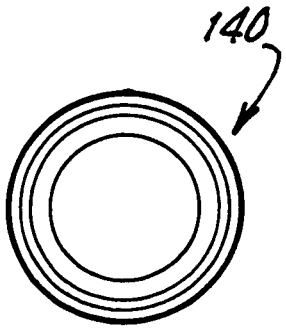
FIGS. 45-47 correspond to FIGS. 30-40 and show another modified hanger, prior to shortening.

FIGS. 38-44 correspond to FIGS. 31-37, respectively, and show another alternative form of the hanger 127 and that employs two or more hydraulic rams, instead of adjustable bolts, for shortening hanger 127 length as from long measurement A (see FIG. 38) to a short measurement B (see FIG. 42). As before, this lowers the casing flange support shoulder 127' on the top of the hanger, by amount A-B below the casing flange 103*a*, thereby relieving energy or tension in the initially hanger suspended casing 103. The hydraulic rams include pistons 135 connected to upper hanger element 310, and projecting downwardly in cylinders 136 connected to lower hanger element 312. Pressurized fluid in the cylinders at 313 is controllably relieved by valve means 314 to allow element 310 to be lowered, shorten the hanger. Valve means 314' controls fluid pressure input to 336. FIGS. 41 and 41' show the hanger prior to and after its axial shortening.

Figure 48:
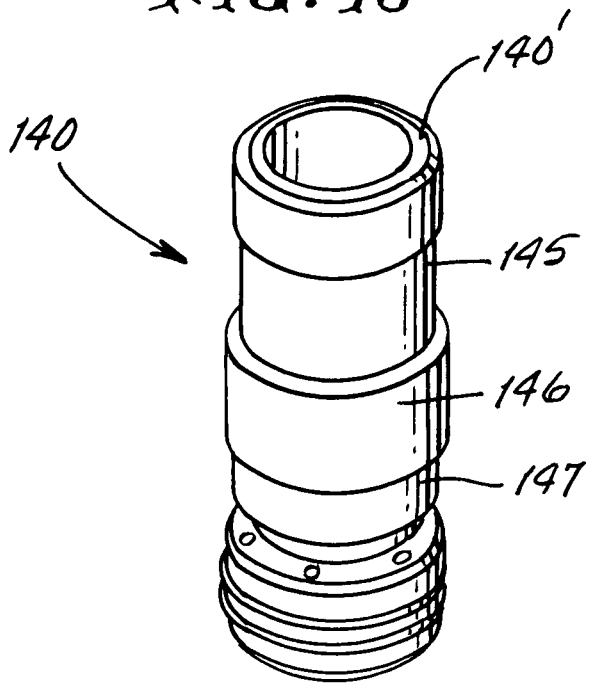
FIG. 48 is an isometric view of the FIGS. 45-47 hanger apparatus.
Figure 45:
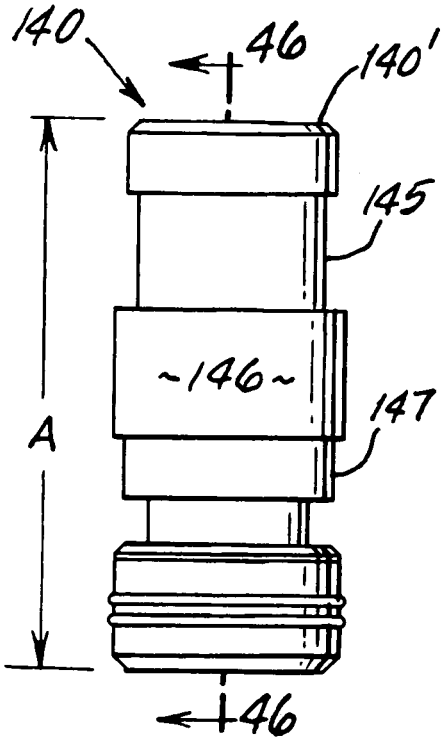
Figure 46:
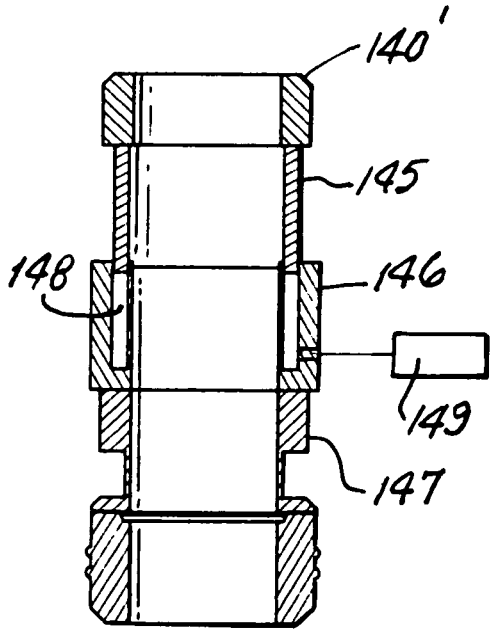
Figure 51:
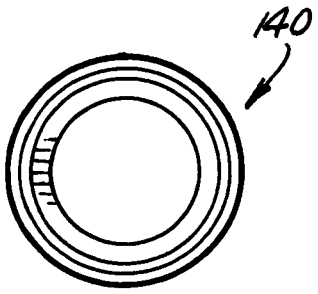
FIGS. 49-51 correspond to FIGS. 45-47, but show the apparatus after shortening.
Figure 48:
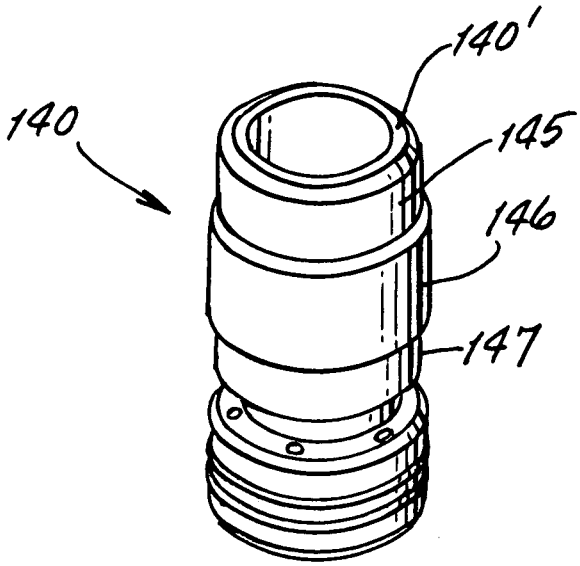
Figure 49:
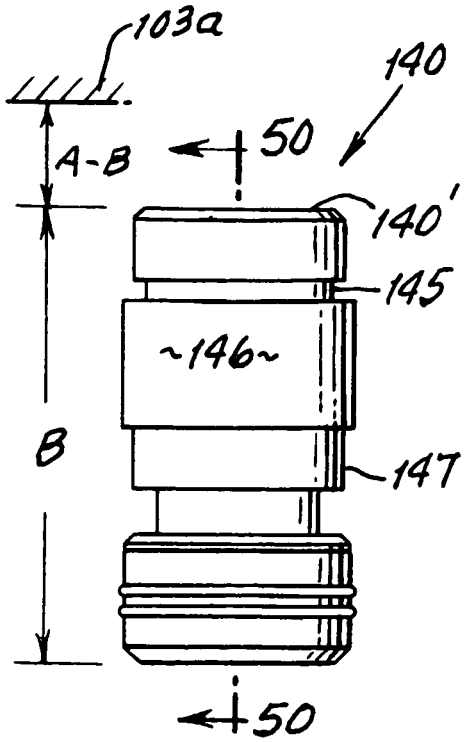
Figure 50:
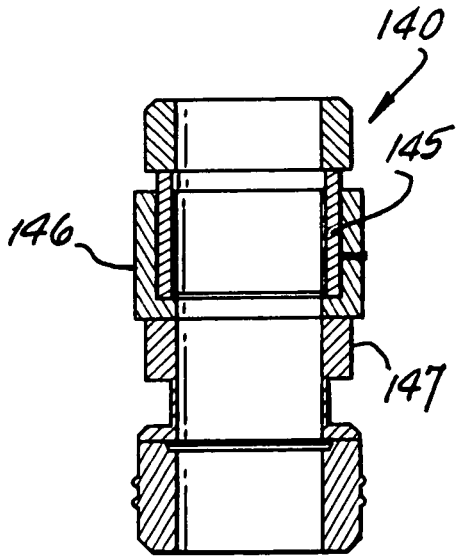
Figure 56:
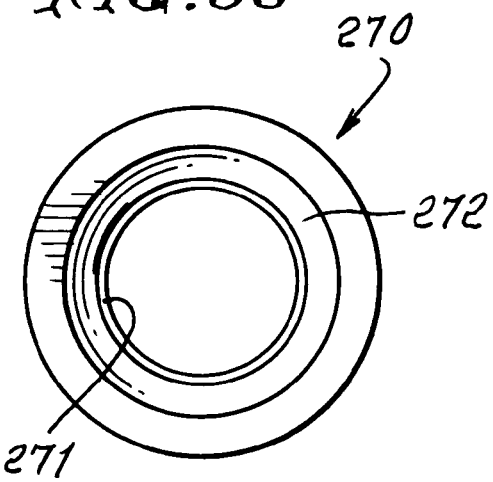
FIGS. 52-56 are an isometric view, side views, a section view, and a top view of a bowl unit that receives the lower sealing element seen in FIGS. 2 and 3.
Figure 52:
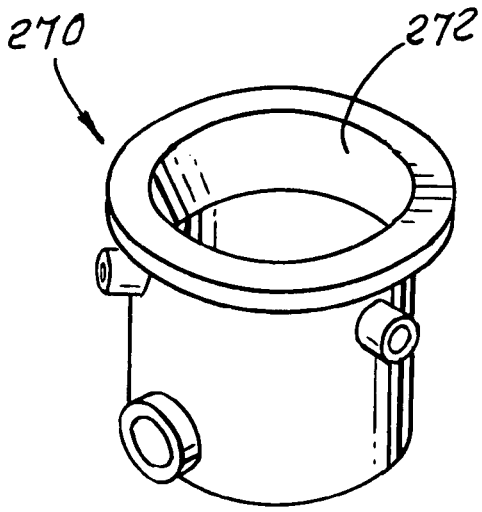
Figure 53:
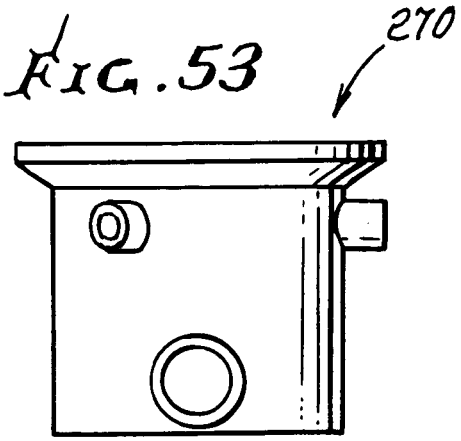
Figure 54:
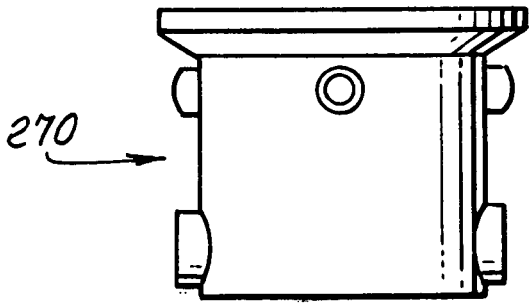
Figure 55:
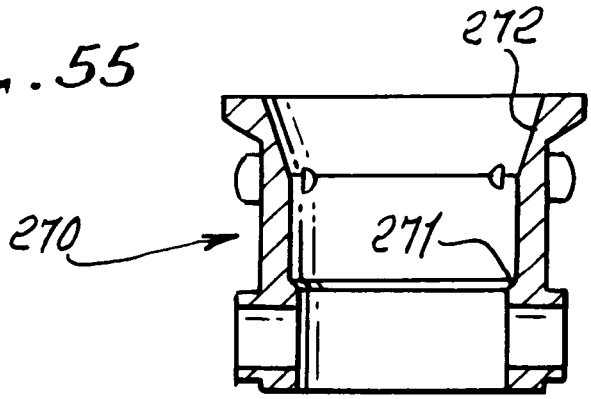
Figure 61:
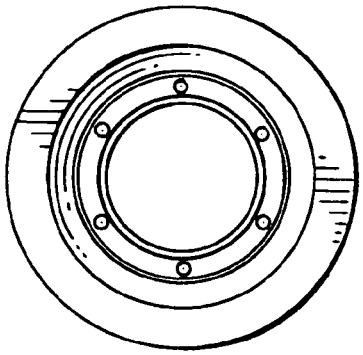
FIGS. 57-61 correspond to FIGS. 52-56, but show a modification, and show a sealing element seated at lower bowl.
Figure 57:
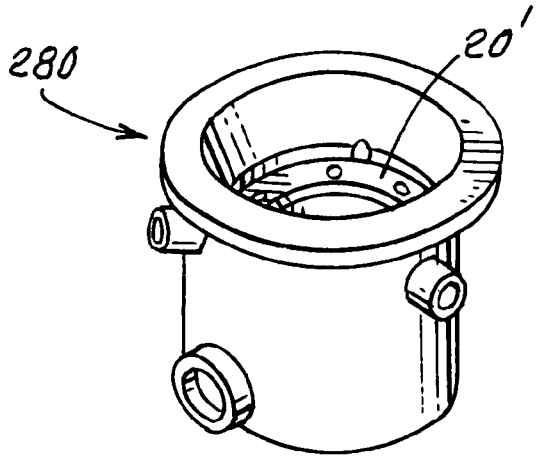
Figure 58:
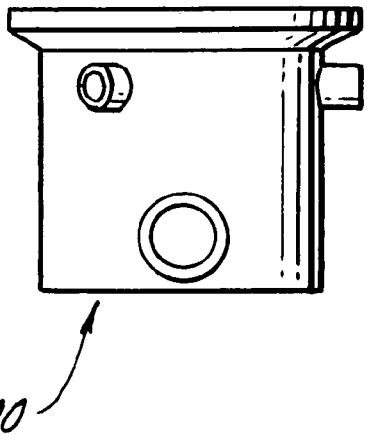
Figure 60:
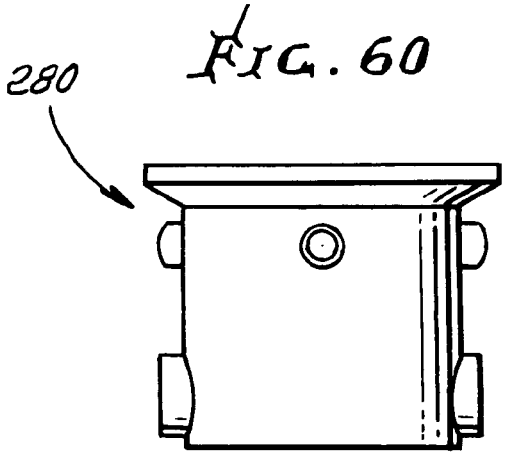
Figure 59:
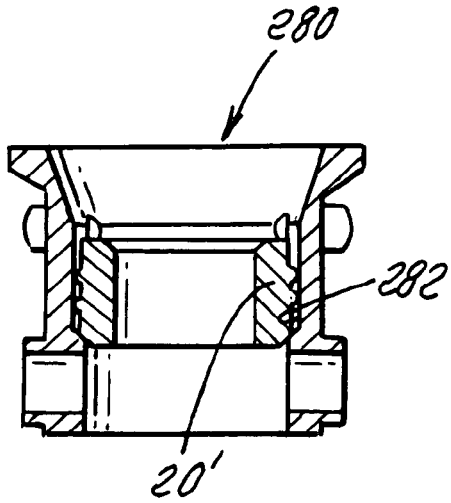

FIGS. 45-51, correspond to FIGS. 38-44 respectively, and show a further alternative form of the hanger 140, and that employs an hydraulic jack type means, instead of adjustable bolts or multiple hydraulic rams, for shortening the hanger 140 length, as from a long measurement A (see FIG. 45) to a short measurement B (see FIG. 49. This lowers the casing flange support shoulder 140' on the top of the hanger, by amount A-B below the casing flange 103*a*, relieving energy or tension in the initially hanger suspended casing 103. The jack means includes a cylindrical piston 145 connected to upper hanger element 140', and projecting downwardly in the cylinder 146 connected to hanger lower element 147, corresponding to 112. Pressurized fluid in the cylinder space 148 is controllably relieved by valve means 149 to allow element 140 to be lowered to shorten the hanger allowing upward removal of 140', 146 and 147. FIGS. 48 and 48' show the hanger prior to and after axial shortening.

FIGS. 52-56 show a retrievable lower bowl assembly 270 which is of generally cylindrical configuration to receive the hanger lower sealing element, as shown at 20 in FIG. 6, for sealing. An internal seating shoulder appears at 271. Downwardly tapered bowl surface is shown at 272.

FIGS. 57-61 are like 52-56 and show a retrievable lower bowl assembly, at 280, and which also is generally cylindrical. A modified mandrel 20' is received in the bowl assembly and seats at annular shoulder 282. Mandrel 20' connects to and is part of the hanger assembly, as described. The bowl assembly is typically welded to well conductor pipe. Other attachment means can be used.

Figures 62, 63:
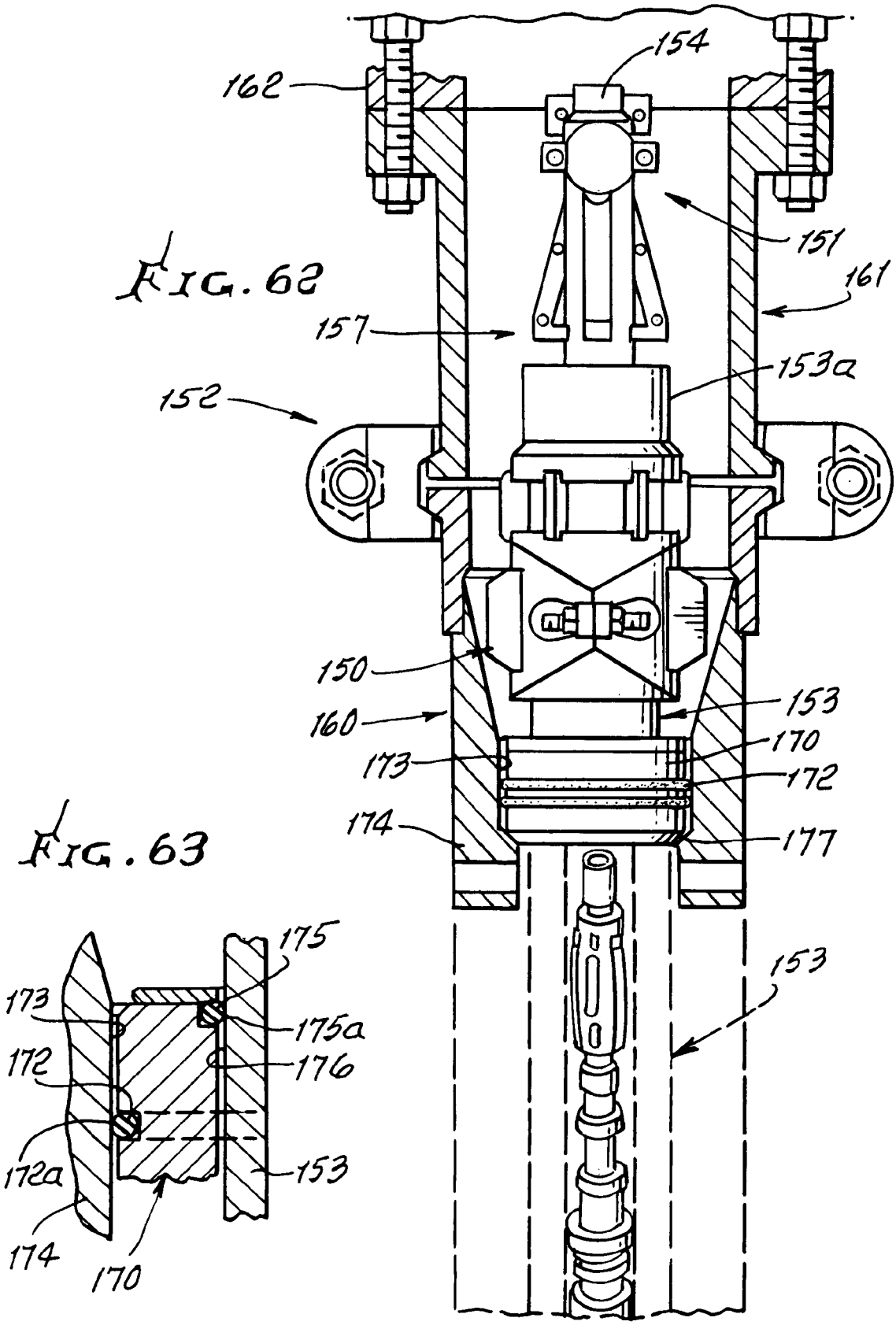
FIG. 62 shows a double hung casing installation.
FIG. 63 shows slidable mandrel sealing.

Accordingly, the invention provides a retrievable landing system capable of landing casing string weight before or during cement jobs. It enables removal of casing string weight off the landing system which then can be easily removed and re-used FIG. 62 shows a double hung casing installation, including first means at dual vertical levels or locations 150 and 151 at a well head 152, for supporting larger diameter hung casing 153 at lower location 150, and for supporting smaller diameter hung casing 154 at upper location 151. Structure 157 supported on collar 153*a* supports 151.

Each or both of the first means at the locations 150 and 151 may take the form of the devices shown in FIGS. 1-8, or FIGS. 31-37 or FIGS. 38-43, or FIGS. 45-51. Removable surrounding spools are indicated at 160-162.

Second means for controlling releasing energy stored in the double hung casing, or in each of such casings, in response to controlled reduction in casing support, is provided, for example in the adjustments described above in connection with operation of elements in said Figures.

FIGS. 62 and 63 also show an annular supporting mandrel 170 extending about the casings, and bodily relatively movable or slidable on and lengthwise of the casing, below the double or single hung casing location. As seen in FIGS. 62 and 63, the slidable mandrel carries and is sealed by O-rings 172, as at 172*a* with the bore 173 of structure 174, and by O-ring 175 as at 175*a* with the outer surface 176 of casing 153. That ring is pressurized or deformed for sealing. A landing shoulder for the mandrel bevel is provided at 177.

Accordingly, an additional object includes provision of:

a) a first means providing a double hung casing installation, at a well head, and characterized by energy storage in supported casing, b) And second means for controllably releasing energy storage in the double hung casing in response to controlled reduction in casing support, whereby associated equipment maybe retrieved at the well head, saving time and expense.

Another object includes provision of adjustable support structure extending under casing head structure or structures, and controllably bodily movable out from under the casing head structure or structures after cementing of casing lower extent or extents in the well, and after energy release, as referred to.

I claim:

1. In a method of installing a plurality of casing sections in a well, the steps that include:

a) providing a hanger supporting the casing sections to extend longitudinally in the well, b) landing the hanger on structure at a well head, whereby weight of the casing sections longitudinally compresses the hanger, c) cementing casing sections in position in the well, below the hanger, d) adjusting the hanger to provide for controllable longitudinal shortening of hanger length, thereby removing exertion of casing weight on the hanger, and e) removing at least part of the hanger away from the well head.

2. The method of claim 1 wherein the hanger has interengaged diagonal wedge surfaces that induce lateral expansion of the hanger, in response to said adjusting.

3. The method of claim 2 wherein said wedge surfaces extend diagonally angularly directionally laterally and longitudinally.

4. The method of claim 2 wherein said wedge surfaces define upper and lower interengaged surfaces.

5. The method of claim 4 wherein said hanger has expansible wall portions on which at least one of said wedge surfaces is located.

6. The method of claim 5 including retention means blocking said wall portions against expansion, and adjustable to allow unblocking of said lateral expansion of the hanger.

7. The method of claim 2 including providing retention means blocking said hanger lateral expansion until said adjusting effects unlocking of hanger lateral expansion.

8. The method of claim 2 wherein said lateral expansion of the hanger serves to facilitate removal of an upper portion of the hanger from the well.

9. The method of claim 1 including severing of an upper portion of the hanger from a lower mandrel portion of the hanger, to allow said removing of said upper portion of the hanger from the well, the lower mandrel portion supporting wedge surfaces for relative sliding.

10. The method of claim 1 wherein said adjusting comprising relieving an axially exerted force acting to block shortening of the hanger.

11. The method of claim 10 wherein said axially exerted force is provided by one of the following:

i) axially extending bolts exerting force on axially spaced hanger sections, ii) axially extending hydraulic ram structure exerting force on axially spaced hanger sections, and iii) axially extending jacking structure exerting force in axially spaced hanger sections.

12. The method of claim 1 wherein the hanger includes a tubular mandrel below and supporting hanger sections that are relatively movable to shorten the hanger length, and including landing said mandrel in tubular structure at the well head.

13. The method of claim 12 wherein said tubular structure is provided to define an upwardly facing bowl surface.

14. Apparatus facilitating installation of a plurality of casing sections endwise in a well, that comprises:

a) a hanger for supporting the casing sections in the well, b) the hanger having a shoulder for landing the hanger in the well, whereby weight of the casing sections serves to longitudinally compress the hanger, c) the casing sections being installable to become connected in position in the well, below hanger level, d) the hanger having adjustable means to provide for controllable longitudinal shortening of the hanger length, thereby removing of casing weight imposed on the hanger, e) whereby at least an upper portion of the shortened hanger may be removed from the well, free of casing weight.

15. The apparatus of claim 14 wherein the hanger has interengaged wedge surfaces that induce lateral expansion of the hanger in response to adjustment of said adjustable means.

16. The apparatus of claim 15 wherein said wedge surfaces extend angularly directionally laterally and longitudinally.

17. The apparatus of claim 15 wherein said wedge surfaces define upper and lower interengaged surfaces comprising a V-shape, with said V-shape acting to hold the hanger in vertical position during relative sliding of said wedge surfaces.

18. The apparatus of claim 17 wherein said hanger has expansible wall portions at which at least one of said wedge surfaces is located.

19. The apparatus of claim 18 including retention means including threaded fastener structure blocking said wall portions against expansion, and adjustable to allow unblocking of said lateral expansion of the hanger.

20. The apparatus of claim 14 including providing adjustable retention means blocking said hanger lateral expansion until said adjusting effects unblocking of hanger lateral expansion.

21. The apparatus of claim 14 wherein the hanger has a lower mandrel portion from which said hanger upper portion, when expanded, may be severed, to allow removal of said upper portion from the well.

22. The apparatus of claim 21 including well structure in which said mandrel portion is landed prior to severing of said upper portion from said lower portion.

23. The apparatus of claim 14 wherein said adjustable means comprises one of the following:

i) axially extending bolts exerting force on axially spaced hanger sections, ii) axially extending hydraulic ram structure exerting force on axially spaced hanger sections, and iii) axially extending jacking structure exerting force in axially spaced hanger sections.

24. In a system for recovering hydrocarbon resources from subsurface strata, a method for installing a plurality of joints of casing in a well, wherein landing means is provided in the well, the plurality of joints comprising a first string, the method comprising the steps of:

a) running the string of joints into the well;

b) providing and locating a hanger proximate a last joint of the string, the hanger having a top, a bottom, an inside diameter, and means for suspending the hanger within the well, the last joint comprising retention means, such that the first string is suspended by the engagement of the retention means with the hanger, the hanger comprising length adjustment means, such that the hanger is adjustable between a first length and a second length, the first length longer than the second length;

c) suspending the first string of casing within the well by engaging said means for suspending the hanger within the well with landing means, with the hanger set at said first length;

d) cementing the first string of casing within the well;

e) allowing the cement to reach a predetermined strength; and suspending the second string and/or additional strings off casing in the well; and f) adjusting the hanger to said second length, said adjusting including forcibly expanding the hanger, to facilitate hanger removal away from a casing head.

25. The method of claim 24, further comprising the step of removing the hanger from the last joint of the first string.

26. The method of claim 24 including providing a second string of casing, to be run into the first string of casing.

27. The method of claim 26, the landing means set within a joint in the second string of casing.

28. The method of claim 26 wherein the landing means on top of the last collar of the first string includes a landing ring attached to the inside diameter of the second string.

29. The method of claim 24 wherein the retention means comprises a collar.

30. The method of claim 24 wherein the retention means comprises a clamp.

31. The method of claim 24 wherein the retention means comprises a ring welded to an outside diameter of the last joint.

32. In a well system, drilled for purposes of recovering hydrocarbon resources from subsurface strata, the well system comprising a string of conductor casing, there being landing means, a method for installing a plurality of joints of casing in the well, the plurality of joints comprising a second string, the method including the steps:

a) installing the second string of joints into the conductor casing;

b) providing and attaching a hanger to a last joint of the installed second string, the hanger having a top, a bottom, an inside diameter, an outside diameter, and means for suspending the hanger within the conductor casing, the last joint comprising retention means, such that the installed second string is suspended by engagement of the retention means with the top of the hanger, the hanger having length adjustment means, such that the hanger is adjustable between a first length and a second length, the first length longer than the second length;

c) suspending the second string within the well by engaging the means for suspending the hanger within the conductor casing with the landing means, with the hanger set at said first length;

d) cementing the second string within the well;

e) allowing the cement to reach a predetermined strength; and f) adjusting the hanger to said second length, said adjusting including forcibly lengthening the hanger.

33. The method of claim 32 wherein the hanger comprises a mandrel section depending from the hanger, the mandrel section comprising one or more 0-rings for sealing of the last joint of any one of the plurality of strings of casing.

34. The method of claim 32, further comprising the step of removing the hanger from the last joint of the second string.

35. In combination, a) first means providing a double hung casing installation, at a well head, and characterized by energy storage in supported casing, and b) second means for controllably releasing energy storage in the double hung casing in response to controlled reduction in casing support, whereby associated equipment may be retrieved at the well head.

36. The combination of claim 35 wherein said second means includes adjustable support structure extending under casing head structure or structures, and controllably bodily movable out from under the casing head structure or structures after cementing of casing lower extent or extents in the well.

37. The combination of claim 36 wherein said support structure includes an annular mandrel extending about the casing and bodily movable on and lengthwise of the casing, below the adjustable support structure.

38. The combination of claim 37 wherein said adjustable support structure includes support elements having relatively slidable and engaged surfaces extending at downward and lateral angularity relative to a downward axis defined by the casing, to allow energy releasing surface slippage.

39. The combination of claim 37 wherein said adjustable support structure includes vertically extending support elements that are vertically adjustable relative to a vertical axis defined by the casing, to allow energy release in response to said vertical adjustment.

40. The combination of claim 39 wherein said support elements include one of the following:

i) vertically extending rods ii) vertically extending bolts, and iii) vertically extending pistons and cylinders.

41. In combination, a) first means providing a hung casing installation, at a well head, and characterized by energy storage in supported casing, and b) second means for controllably releasing energy storage in or proximate the hung casing in response to controlled release of casing support, whereby associated equipment may be retrieved at the well head, wherein said second means includes adjustable support structure extending under casing head structure or structures, and controllably bodily movable out from under casing head structure or structures after cementing of casing lower extent or extents in a well.

* * * * *

US008522884C1

(12) EX PARTE REEXAMINATION CERTIFICATE (104th)

Ex Parte Reexamination Ordered under 35 U.S.C. 257

United States Patent
Miller

(10) Number: US 8,522,884 C1
(45) Certificate Issued: Jan. 12, 2018

(54) LANDING SYSTEM FOR WELL CASING

(75) Inventor: David M. Miller, Bakersfield, CA (US)

(73) Assignee: David M. Miller, Bakersfield, CA (US)

Supplemental Examination Request:
No. 96/000,160, Sep. 7, 2016

Reexamination Certificate for:

| | |
|---|---|
| Patent No.: | **8,522,884** |
| Issued: | **Sep. 3, 2013** |
| Appl. No.: | **12/927,572** |
| Filed: | **Nov. 17, 2010** |

Related U.S. Application Data

(60) Provisional application No. 61/262,912, filed on Dec. 7, 2009.

(51) Int. Cl.
*E21B 23/02* (2006.01)
*E21B 33/02* (2006.01)

(52) U.S. Cl.
CPC ..... *E21B 33/02* (2013.01)

(58) Field of Classification Search
USPC ..... 166/382
See application file for complete search history.

(56) References Cited

To view the complete listing of prior art documents cited during the supplemental examination proceeding and the resulting reexamination proceeding for Control Number 96/000,160, please refer to the USPTO's public Patent Application Information Retrieval (PAIR) system under the Display References tab.

*Primary Examiner* — Matthew C Graham

(57) ABSTRACT

The method of installing a plurality of casing sections in a well, that includes providing a hanger supporting the casing sections to extend longitudinally in the well, landing the hanger on structure in the well, whereby weight of the casing sections longitudinally compresses the hanger, cementing the casing sections in position in the well, below the hanger, adjusting the hanger to provide for controllable longitudinal shortening of hanger length, thereby removing exertion of casing weight on the hanger, and removing at least part of the hanger away from the well head.

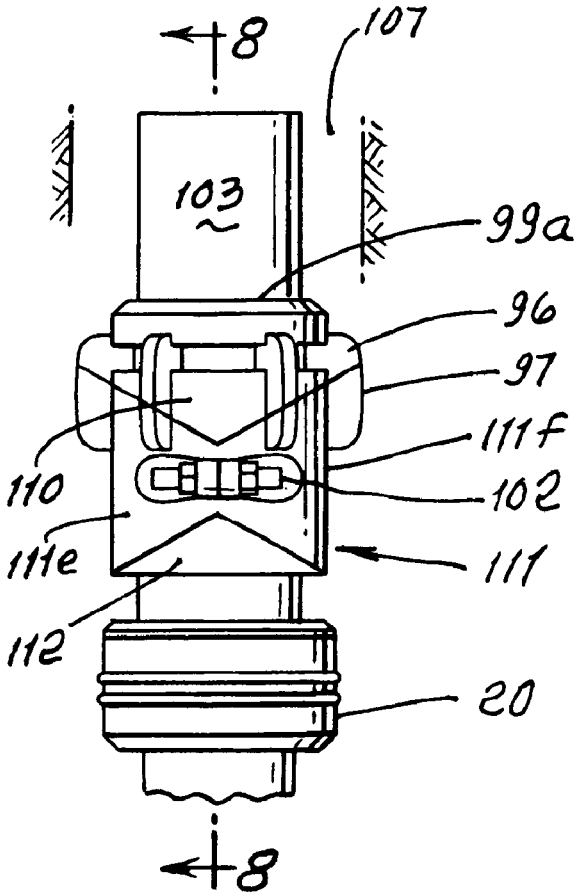

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 14, 19, 24, 26, 32, 35 and 41 are determined to be patentable as amended.

Claims 2-13, 15-18, 20-23, 25, 27-31, 33-34 and 36-40, dependent on an amended claim, are determined to be patentable.

New claims 42-53 are added and determined to be patentable.

1. [In a] *A* method of installing a plurality of casing sections in a well, the [steps that include] *method comprising*:

a) providing a hanger supporting the casing sections to extend longitudinally in the well, *the hanger comprising an upper member and a lower member, the upper member being selectively movable toward the lower member to selectively adjust a length of the hanger,* b) landing the hanger on structure at a well head, whereby weight of the casing sections longitudinally compresses the hanger, c) cementing casing sections in position in the well, below the hanger, d) adjusting the hanger to *selectively move the upper member towards the lower member to* provide for controllable longitudinal shortening of *the* hanger length, thereby removing exertion of casing *section* weight on the hanger, and e) removing at least part of the hanger away from the well head.

14. Apparatus facilitating installation of a plurality of casing sections endwise in a well, [that comprises] *the apparatus comprising*:

a) a hanger for supporting the casing sections in the well, *the hanger comprising an upper member and a lower member, the upper member being selectively movable toward the lower member to selectively adjust a length of the hanger,* b) the hanger having a shoulder for landing the hanger in the well, whereby weight of the casing sections serves to longitudinally compress the hanger, c) the casing sections being [installable to become connected in position] *suspended* in the well, below hanger level, d) the hanger having adjustable means to *enable selective movement of the upper member towards the lower member to* provide for controllable longitudinal shortening of the hanger length[, thereby removing] *and removal* of casing weight imposed on the hanger, e) whereby at least an upper portion of the shortened hanger may be removed from the well, free of casing weight.

19. The apparatus of claim 18 including retention means including threaded fastener structure blocking said *expansible* wall portions against expansion, and adjustable to allow unblocking of said lateral expansion of the hanger.

24. [In a system for recovering hydrocarbon resources from subsurface strata, a] *A* method for installing a plurality of joints of casing in a well, wherein landing means is provided in the well, the plurality of joints comprising a first string, the method comprising the steps of:

a) running the string of joints into the well;

b) providing and locating a hanger proximate a last joint of the string, the hanger having *an upper member, a lower member,* a top, a bottom, an inside diameter, and means for suspending the hanger within the well, the last joint comprising retention means, such that the first string is suspended by [the] engagement of the retention means with the hanger, the hanger comprising length adjustment means *for enabling selective movement of the upper member towards the lower member*, such that the hanger is adjustable between a first length and a second length, the first length longer than the second length;

c) suspending the first string of casing within the well by engaging said means for suspending the hanger within the well with landing means, with the hanger set at said first length;

d) cementing the first string of casing within the well;

e) allowing the cement to reach a predetermined strength[;], and suspending [the] *a* second string and/or additional strings off casing in the well; and f) adjusting the hanger to said second length, said adjusting including [forcibly expanding] *shortening* the hanger *by moving the upper member towards the lower member*, to facilitate hanger removal away from a casing head.

26. The method of claim 24 including providing [a] *the* second string of casing, to be run into the first string of casing.

32. [In a well system, drilled for purposes of recovering hydrocarbon resources from subsurface strata, the well system comprising a string of conductor casing, there being landing means, a] *A* method for installing a plurality of joints of casing in [the] *a* well *system that includes a well, a string of conductor casing, and landing means*, the plurality of joints comprising a second string, the method including the steps:

a) installing the second string of joints into the conductor casing;

b) providing and attaching a hanger to a last joint of the installed second string, the hanger having *an upper member, a lower member,* a top, a bottom, an inside diameter, an outside diameter, and means for suspending the hanger within the conductor casing, [the] *a* last joint comprising retention means, such that the installed second string is suspended by engagement of the retention means with the top of the hanger, the hanger having length adjustment means *for enabling selective movement of the upper member towards the lower member*, such that the hanger is adjustable between a first length and a second length, the first length longer than the second length;

c) suspending the second string within the well by engaging the means for suspending the hanger within the conductor casing with the landing means, with the hanger set at said first length;

d) cementing the second string within the well;

e) allowing the cement to reach a predetermined strength; and f) adjusting the hanger to said second length, said adjusting including [forcibly lengthening] *shortening* the hanger *by selectively moving the upper member towards the lower member*.

35. In combination, a) first means providing a double hung casing installation, at a well head, and characterized by energy storage in supported casing, *the first means including an upper member and a lower member, the upper member being selectively movable towards the lower member*, and b) second means for controllably releasing energy storage in the double hung casing in response to controlled reduction in casing support, whereby associated equipment may be retrieved at the well head, *the second means being configured to selectively enable the upper member to move towards the lower member*.

41. In combination, a) first means providing a hung casing installation, at a well head, and characterized by energy storage in supported casing, *the first means including an upper member and a lower member, the upper member being selectively movable towards the lower member*, and b) second means for controllably releasing energy storage in or proximate the hung casing in response to controlled release of casing support, whereby associated equipment may be retrieved at the well head, *the second means being configured to selectively enable the upper member to move towards the lower member*, wherein said second means includes adjustable support structure extending under casing head structure or structures, and controllably bodily movable out from under casing head structure or structures after cementing of casing lower extent or extents in a well.

*42. A hanger for use in installing casing sections in a well, the hanger comprising:*

*an upper member;*

*a lower member;*

*at least two intermediate members disposed between the upper member and the lower member;*

*a fastener that is selectively movable between a tightened configuration and a loosened configuration, wherein:*

*movement of the fastener from the tightened configuration to the loosened configuration is configured to result in lateral translation or expansion of the at least two intermediate members, and*

*lateral translation or expansion of the at least two intermediate members is configured to enable the upper member to move towards the lower member such that a length of the hanger decreases.*

*43. The hanger of claim 42, wherein the upper member and the at least two intermediate members comprise corresponding wedge surfaces to facilitate movement of the upper member towards the lower member upon lateral translation or expansion of the at least two intermediate members.*

*44. The hanger of claim 43, wherein the corresponding wedge surfaces comprise corresponding V-shaped wedge surfaces.*

*45. The hanger of claim 42, wherein the lower member and the at least two intermediate members comprise corresponding wedge surfaces to facilitate movement of the upper member towards the lower member upon lateral translation or expansion of the at least two intermediate members.*

*46. The hanger of claim 45, wherein the corresponding wedge surfaces comprise corresponding inverted V-shaped wedge surfaces.*

*47. The hanger of claim 42, wherein the fastener comprises one or more bolts connected between flanges on the at least two intermediate members.*

*48. A hanger for use in installing casing sections in a well, the hanger comprising:*

*an upper member comprising downward facing wedge surface;*

*at least two intermediate members comprising upward facing wedge surfaces and downward facing wedge surfaces, the upward facing wedge surfaces engaging the downward facing wedge surfaces of the upper member;*

*a lower member comprising upward facing wedge surfaces that engage the downward facing wedge surfaces of the at least two intermediate members; and*

*a fastener connected between the at least two intermediate members.*

*49. The hanger of claim 48, wherein the at least two intermediate members are configured to for selective lateral translation or expansion.*

*50. The hanger of claim 49, wherein lateral translation or expansion of the at least two intermediate surfaces enables the upper member to move towards the lower member such that a length of the hanger decreases.*

*51. The hanger of claim 49, wherein lateral translation or expansion of the at least two intermediate surfaces enables the at least two intermediate members to move towards the lower member such that a length of the hanger decreases.*

*52. The hanger of claim 49, where in the fastener is selectively movable between a tightened configuration and a loosened configuration, wherein movement of the fastener from the tightened configuration to the loosened configuration is configured to result in the lateral translation or expansion of the at least two intermediate members.*

*53. The hanger of claim 48, wherein the fastener comprises one or more bolts connected between flanges on the at least two intermediate members.*

* * * * *